US005125189A

United States Patent [19]

Holmin et al.

[11] Patent Number: 5,125,189

[45] Date of Patent: Jun. 30, 1992

[54] VIBRATION DAMPED HAND HELD ROTARY GRINDING MACHINE

[75] Inventors: Mats C. Holmin, Stockholm; Sten H. Olsson, Enskede; Lars T. Skogsberg, Stenhamra, all of Sweden

[73] Assignee: Atlas Copco Tools AB, Stockholm, Sweden

[21] Appl. No.: 696,068

[22] Filed: May 6, 1991

[30] Foreign Application Priority Data

May 4, 1990 [SE] Sweden ..... 9001620

[51] Int. Cl.[5] ..... B24B 23/00; B24B 55/04

[52] U.S. Cl. ..... 51/170 R; 51/268

[58] Field of Search ..... 51/170 R, 169, 170 PT, 51/170 T, 170 MT, 268

[56] References Cited

FOREIGN PATENT DOCUMENTS 2826414 12/1979 Fed. Rep. of Germany ..... 51/268

0074564 4/1987 Japan ..... 51/170 MT

*Primary Examiner*—Roscoe V. Parker

*Attorney, Agent, or Firm*—Frishauf, Holtz, Goodman & Woodward

[57] ABSTRACT

A vibration damped hand held rotary grinding machine comprising a housing (10) with at least one handle (17, 18), a rotation motor (11), an output shaft (13) drivingly coupled to the motor and having a mounting (14) for attachment of a grinding wheel (15), and a sector-shaped non-resilient safe guard (19) which is rigidly attached to the housing (10) and surrounding partially the grinding wheel (15) and which has an arc-shaped rim portion (20) encircling partially the grinding wheel circumference. A vibration damping inertia device (**22; 22*a*, 22*b*) is rigidly associated with the safe guard (19) on or adjacent the rim portion (20), such that the center of gravity of substantially all axial plane cross sections through the inertia device (22 22*a*, 22*b*) is located at a radius ($R_1$) of at least 90% of the rim portion (20) radius (R). Preferably, the safe guard (19) is semicircular and th einertia device (22; 22*a*, 22*b*) extends from both ends of the safe guard rim portion (20**).

12 Claims, 3 Drawing Sheets

VIBRATION DAMPED HAND HELD ROTARY GRINDING MACHINE

BACKGROUND OF THE INVENTION

This invention concerns a vibration damped hand held rotary grinding machine, in particular a grinding machine of the above described type comprising a housing with at least one handle, a rotation motor, an output shaft drivingly coupled to the motor and having mounting means for attachment of a grinding wheel, and a sector-shaped nonresilient safe guard which is rigidly attached to the housing and surrounding partially the grinding wheel and which has an arc-shaped rim portion encircling partially the grinding wheel circumference.

Vibrations developed in portable grinding machines of the above type emanate from the grinding wheel and are caused by an untrue or unbalanced running of the grinding wheel. This is due to a poor balancing of the grinding wheel at manufacturing, an inaccurate mounting on the tool shaft and to an uneven wear of the grinding wheel after some times use. Vibration forces are also generated at the contact between the grinding wheel and the work piece.

Accordingly, all vibration forces developed in the machine and to which the operator is exposed via the machine housing handles emanate from the grinding wheel and are transferred to the machine housing via the output shaft. Even if an accurate preuse balancing and centering of the grinding wheel were obtained there would still be vibration forces developed during grinding, which means that measures have to be taken to minimize the vibration forces transferred to the operator. There are two ways for lowering the vibration force transfer to the operator, namely:

a) insulating the handles by resilient vibration absorbing means, and
b) employing means for absorbing the vibration forces, and, thereby, damping the vibrations in the machine housing.

Whereas a large variety of resilient vibration insulating handles for portable power tools have been used in the past, there are no examples in prior art of any effective vibration mitigating or damping means or of any measures taken to reduce substantially the vibrations in the machine housing.

The object of the invention is to accomplish an improved vibration damped hand held rotary grinding machine in which the vibration forces transferred to the machine housing via the output shaft are effectively counteracted and absorbed. This is obtained by changing the inertia characteristics of the machine as defined in the claims.

Preferred embodiments of the invention are hereinafter described in detail with reference to the accompanying drawings.

DETAILED DESCRIPTION

Figure 1:
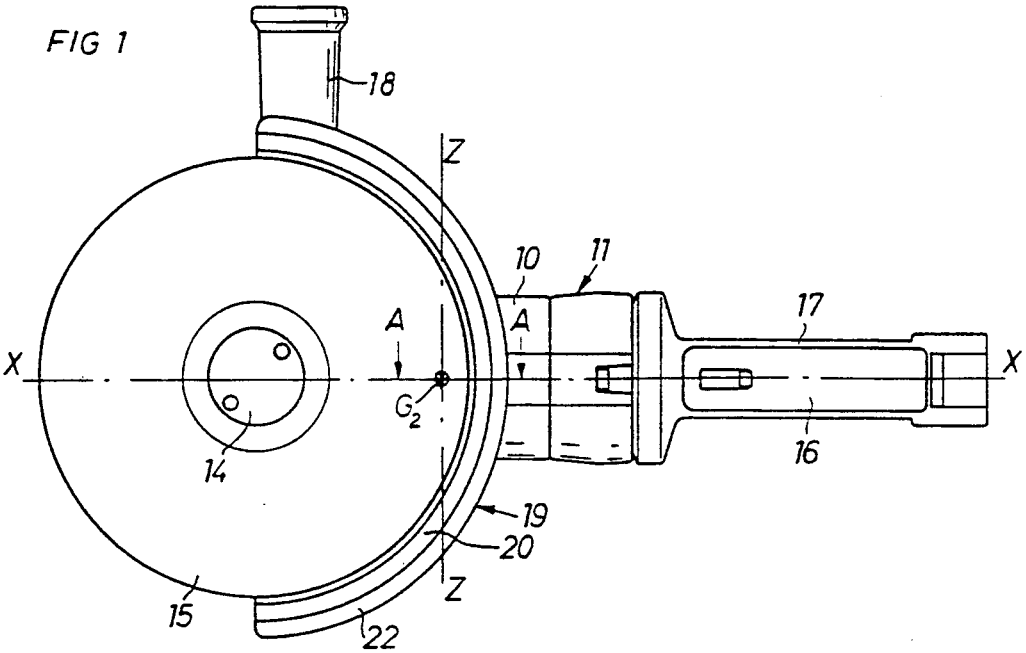
FIG. 1 shows a bottom view of a grinding machine according to the invention.
Figure 2:
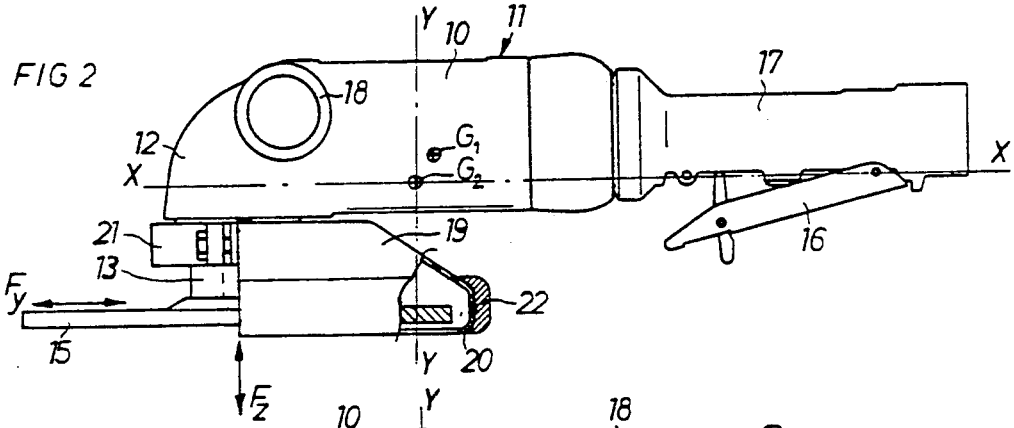
FIG. 2 shows a side view of the grinding machine in FIG. 1.
Figure 3:
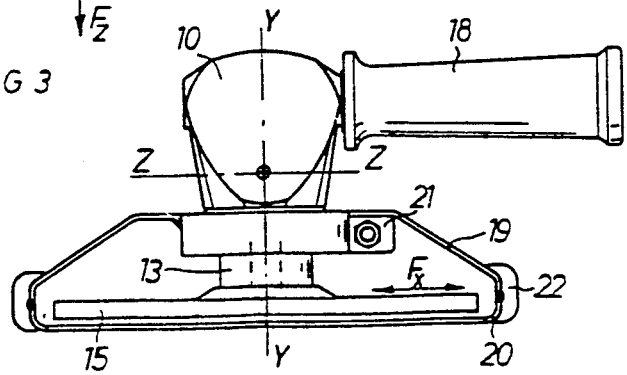
FIG. 3 shows a front end view of the grinding machine in FIG. 1.

The grinding machine shown in FIGS. 1-3 is of the angle grinder type in which the housing 10 supports a pneumatic rotation motor 11 which via an angle gear 12 rotates an output shaft 13. The latter carries a mounting device 14 by which a grinding wheel 15 of the depressed center type is secured to the shaft 13.

Two handles 17, 18 are rigidly attached to the housing 10, one of which 17 is a straight extension of the housing 10 and comprises a pressure air supply passage and a throttle valve. A lever 16 is provided for manual control of the throttle valve. The other handle 18 is mounted in a right angle both to the output shaft 13 and to the throttle valve handle 17.

To the housing 10 there is also rigidly secured a grinding wheel safe guard 19 which encloses partially the grinding wheel 15. The rim portion 20 of the safe guard 19 extends over a 180° sector and, accordingly, it covers half the circumference of the grinding wheel 15. The safe guard 19 is secured to the housing 10 by means of a clamping device 21.

Figure 6:
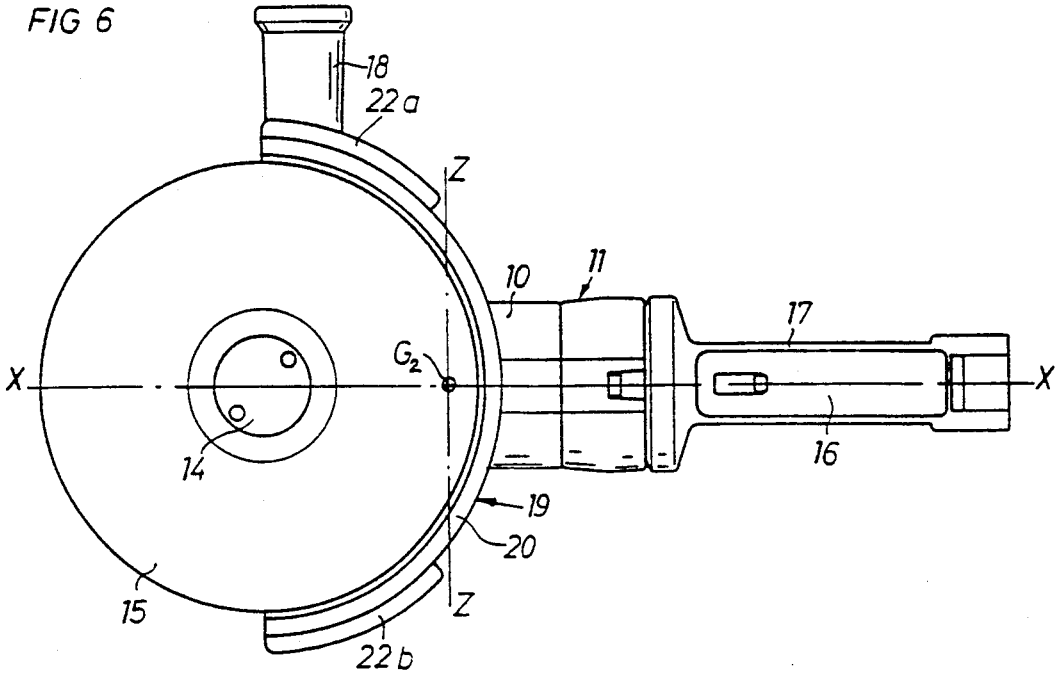
FIGS. 6 and 7 show respective bottom views of a grinding machine according to other embodiments of the invention.

A vibration damping means in the form of an inertia element 22 is rigidly attached to the rim portion 20. This inertia element 22 is crest-shaped and extends either over the entire length of the rim portion 20, as illustrated in FIGS. 1-3, or over the end parts only of the rim portion 20, as illustrated in FIG. 6.

The basic principle for the vibration damping arrangement according to the invention is that mass i added to the safe guard in such a way that the moment of inertia of the tool is substantially increased in the critical direction or directions, i.e. the direction or directions in which the original moment of inertia of the machine is low and in which the vibration amplitude is large.

This goes for the moment of inertia relative to the length axis of the tool housing 10 and the handle 17, in particular. By adding inertia to the outer parts of the safe guard, the moment of inertia about the length axis of the housing 10 is substantially increased. This is obtained by mounting a semicircular inertia element 22 to safe guard rim portion 20 as illustrated in FIGS. 1-3, or by mounting shorter part-circular inertia elements **22*a* and 22*b* at the ends of the rim portion 20, as in FIG. 6**.

By adding mass to the safe guard, there is also obtained a displacement of the center of gravity of the machine towards the grinding wheel, which means that the vibration forces generated by the grinding wheel will act at a shorter radius visavi the center of gravity of the machine and will, therefore, have a less vibratory influence on the machine. This is illustrated in FIG. 2, where G, is the original center of gravity and $G_2$ is the new center of gravity determined by the mass added to the safe guard rim portion.

Figure 4:
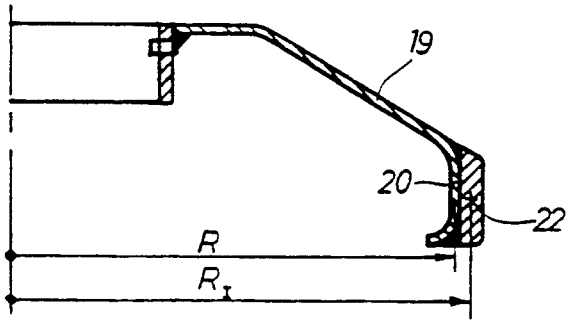
FIGS. 4 and 5 show sections along line A—A in FIG. 1 through safe guards according to two different embodiments of the invention.
Figure 5:
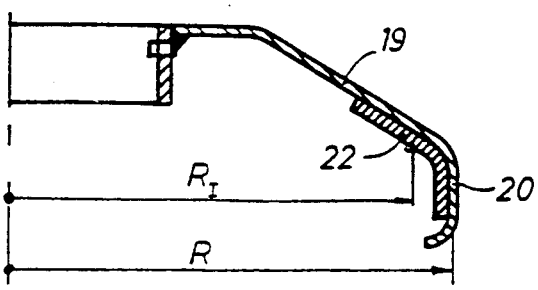

To obtain an efficient vibration damping action by the inertia element or elements, it is of utmost importance that the safe guard 19 in itself is very stiff and does not yield to the inertia forces to be transferred from the housing to the inertia element 22 or elements **22*a*, 22*b*. It is also important that the inertia element 22 or elements 22*a*, 22*b* are located at a large radius relative to the length axis of the machine, and in order to obtain as good a result as possible, the center of gravity of substantially all axial plane cross sections, as in FIGS. 4 and 5, through the inertia member or members should be located at a radius R that is at least 90% of the rim portion 20 radius R. Located at shorter radii, the inertia member or members would add to the weight of the machine without really increasing the moment of inertia of the machine and, thereby, the vibration damping effect. The most preferable arrangement from the moment of inertia point of view is shown in FIG. 4, since in that embodiment the radius R of the center of gravity of the inertia element cross section is even larger than the radius R of the rim portion 20. The embodiment shown in FIG. 5 is somewhat less efficient but may provide a smoother outside surface of the safe guard 19**.

In FIGS. 2 and 3, there are illustrated vibration forces Fx, Fy and Fz which act in three perpendicular directions, and which cause vibratory movements of the machine housing 10 about three perpendicular geometric axes x, y, and z. From the different views shown in the drawing figures it is evident that the moment of inertia of the machine is lowest around the x—x axis, which means that the handle 18 is exposed to severe vibration movement in the vertical direction. However, this is substantially reduced by providing the arc-shaped inertia element 22 at the safe guard rim portion 20. A substantial part of the inertia element 22 is located at a large radius from the x axis, see FIG. 1, which means that the total moment of inertia of the machine is substantially increased.

Figure 7:
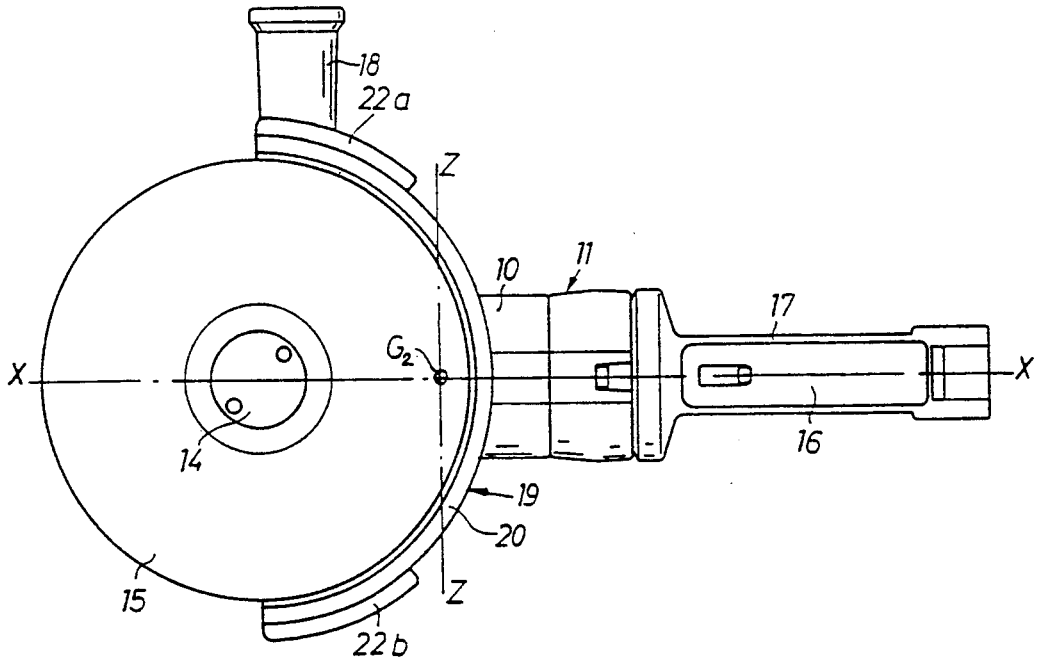

It is to be noted that the machine illustrated in the drawing figures has a very high moment of inertia with reference to the Y- and Z-axes, which means that the middle portion of the inertia element 22, i.e. the portion located closest to the center line or x-axis of the machine, has a very little influence upon the total moment of inertia with reference to the Y- and Z-axes. Therefore, the most efficient way to increase the vibration damping moment of inertia of this type of machine for a certain added mass is to concentrate the added mass to the outer parts of the safe guard as illustrated in FIG. 6. The inertia elements 22*a*, 22*b* has a total length corresponding to half the length of the safe guard rim portion 20 as shown in FIG. 6 or the total length of the inertia elements 22*a*, 22*b* may be less than half the length of the rim portion 20 as shown in FIG. 7. For another type of grinding machine in which the motor is located coaxially with the output shaft, i.e. a machine without an angle gear, the moment of inertia about the x-axis is much lower, and the 180° inertia element would have a greater influence upon that moment of inertia and would be a suitable choice for that type of machine.

By laboratory tests it has been established that for an angle grinder the optimum mass to be added is about 10–20% of the total machine mass. The 180° embodiment shown in FIGS. 1–3 requires a heavier mass than the two-part embodiment shown in FIG. 6 for obtaining the same vibration damping effect.

We claim:

1. A hand held rotary grinding machine, comprising:
a housing with at least one handle;
a rotation motor;
an output shaft drivingly coupled to said motor and having mounting means for attachment of a grinding wheel;
a sector shaped nonresilient safe guard rigidly mounted on said housing and partially surounding said grinding wheel, said safe guard having an arc-shaped rim portion partially encircling the grinding wheel circumference, said rim portion having two ends; and
vibration damping inertia means rigidly associated with said safe guide, said vibration damping inertia means extending from both ends of said rim portion and having a total length of less than 50% of said rim portion; and
wherein the center of gravity of substantially all axial plane cross sections through said inertia means is located at a radius of at least 90% of the rim portion radius.

2. Grinding machine according to claim 1, wherein the center of gravity of substantially all axial plane cross sections through said inertia means is located at a radius exceeding the rim portion radius.

3. Grinding machine according to claim 1, wherein e mass of said inertia means is more than 10% of the total mass of the machine.

4. Grinding machine according to claim 2, wherein he mass of said inertia means is more than 10% of the total mass of the machine.

5. A hand held rotary grinding machine, comprising:
a housing with at least one handle;
a rotation motor;
an output shaft drivingly coupled to said motor and having mounting means for attachment of a grinding wheel;
a sector shaped nonresilient safe guard rigidly mounted on said housing and partially surrounding said grinding wheel, said soft guard having an arc-shaped rim portion partially encircling the grinding wheel circumference, said rim portion having two ends; and
vibration damping inertia means rigidly associated with said saft guard, said vibration damping inertia means comprising an arc-shaped one piece metal member extending over the entire length of said rim portion; and
wherein the center of gravity of substantially all axial plane cross sections through said inertia means is located at a radius of at least 90% of the rim portion radius (R).

6. Grinding machine according to claim 5, wherein the mass of said inertia means is more than 10% of the total mass of the machine.

7. A hand held rotary grinding machine, comprising:
a housing with at least one handle;
a rotation motor;
an output shaft drivingly coupled o said motor and having mounting means for attachment of a grinding wheel;
a sector shaped nonresilient safe guard rigidly mounted on said housing and partially surrounding said grinding wheel, said safe guard having an arc-shaped rim portion partially encircling the grinding wheel circumference, said rim portion having two ends; and
vibration damping inertia means rigidly associated with said safe guard, wherein the mass of said vibration damping inertia means is more than 10% of the total mass of the machine; and
wherein the center of gravity of substantially all axial plane cross sections through said inertia means is located at a radius of at least 90% of the rim portion radius (R).

8. Grinding machine according to claim 7, wherein said inertia means extends from both ends of said rim portion and has a total length of less than 50% of said rim portion.

9. Grinding machine according to claim 7, wherein said inertia means comprises an arc-chaped one-piece metal member extending over the entire length of said rim portion.

10. A hand held rotary grinding machine, comprising:

a housing with at least one handle;

a rotation motor;

an output shaft drivingly coupled to said motor and having mounting means for attachment of a grinding wheel;

a sector shaped nonresilient safe guard rigidly mounted on said housing and partially surrounding said grinding wheel, said safe guard having an arc-shaped rim portion partially encircling the grinding wheel circumference, said rim portion having two ends; and vibration damping inertia means rigidly associated with said safe guard, wherein the mass of said vibration damping inertia means is more than 10% of the total mass of the machine; and wherein the center of gravity of substantially all axial plane cross sections through said inertia means is located at a radius exceeding the rim portion radius (R).

11. Grinding machine according to claim 10, wherein said inertia means extends from both ends of said rim portion and has a total length of less than 50% of said rim portion.

12. Grinding machine according to claim 10, wherein said inertia means comprises an arc-shaped one-piece metal member extending over the entire length of said rim portion.

* * * * *

UNITED STATES PATENT AND TRADEMARK OFFICE

CERTIFICATE OF CORRECTION

PATENT NO. : 5,125,189

DATED : June 30, 1992

INVENTOR(S) : HOLMIN et al

It is certified that error appears in the above-identified patent and that said Letters Patent is hereby corrected as shown below:

item [57]

Title page, Abstract, line 2 from the bottom, replace "th einertia" with --the inertia--.

Column 4, line 18 (claim 3), replace "wherein e" with

--wherein the--.

Column 4, line 22 (claim 4), replace "he mass" with

--the mass--.

Column 4, line 33 (claim 5), replace "soft" with --safe--.

Column 4, line 38 (claim 5), replace "saft" with --safe--.

Column 4, line 52 (claim 6), replace "o" with --to--.

Signed and Sealed this

Nineteenth Day of October, 1993

Bruce Lehman

*Attest:*

BRUCE LEHMAN

*Attesting Officer*

*Commissioner of Patents and Trademarks*